US005265812A

United States Patent [19]

Holopainen et al.

[11] Patent Number: 5,265,812

[45] Date of Patent: Nov. 30, 1993

[54] REELING DRUM

[75] Inventors: Kari Holopainen, Jyväskylä ; Juha Ehrola, Vaajakoski; Silvo Mikkonen, Kajaani, all of Finland

[73] Assignee: Valmet Paper Machinery Inc., Finland

[21] Appl. No.: 832,287

[22] Filed: Feb. 7, 1992

[30] Foreign Application Priority Data

Feb. 20, 1991 [FI] Finland ..... 910833

[51] Int. Cl.[5] ..... B65H 75/02

[52] U.S. Cl. ..... 242/68.5; 242/68

[58] Field of Search ..... 242/68.5, 68, 68.6, 242/68.4, 72 R, 68.1, 71.8, 73.5

[56] References Cited

U.S. PATENT DOCUMENTS

| | | | |
|---|---|---|---|
| 1,990,860 | 2/1935 | Ellsworth | 242/68.5 |
| 3,312,410 | 4/1967 | Strothmann | 242/68.5 |
| 3,447,674 | 6/1969 | Fraser | 242/68.5 |
| 3,655,144 | 4/1972 | Turner | 242/68 |
| 4,641,795 | 2/1987 | Honegger | 242/68.5 |
| 4,989,802 | 2/1991 | Akao et al. | 242/68.5 |

*Primary Examiner*—William A. Cuchlinski, Jr.
*Assistant Examiner*—William C. Dowling
*Attorney, Agent, or Firm*—Steinberg & Raskin

[57] ABSTRACT

The invention concerns a reeling drum for a paper or board machine or equivalent, onto which reeling drum a material web, in particular paper or board, is reeled. Axle journals have been fixed to the ends of the reeling drum in a conventional way by means of end joints. By means of the axle journals, the reeling drum is supported in a revolving manner on a machine frame by means of bearing means. According to the invention, the reeling drum is provided with articulation devices or the like for variation of the deflection of the reeling drum and for equalization of the pressure produced by the material web reeled ont the reeling drum. The reeling drum has an inner mantle supported on the machine frame revolvingly, and an outer mantle fitted on the inner mantle coaxially. A gap remains between the inner mantle and the outer mantle, the outer mantle being supported on the inner mantle by means of the articulation devices.

20 Claims, 3 Drawing Sheets

REELING DRUM

BACKGROUND OF THE INVENTION

The invention concerns a reeling drum for a paper or board machine or equivalent, onto which reeling drum a material web, in particular paper or board, is reeled. Axle journals are fixed to the ends of the reeling drum by means of end joints. By means of the axle journals, the reeling drum is supported in a revolving manner on the machine frame by means of bearing means.

The paper produced in a paper machine is wound around a reeling drum in a reel-up to make a jumbo roll. The most common type of reel-up in use is a reel-up driven from the circumference, wherein the reeling drum revolves against a reeling cylinder. With the present day reeling drums provided with rubber coating or polyurethane coating, the control of the linear load is indefinite at the bottom of the roll.

In the present reeling drums, the hardness of the roll face and the properties of compressibility are quite decisively different from the corresponding properties of paper. As a consequence, when the reeling is started on an empty reeling drum, the desired distribution of hardness and density of the reeled paper is not attained.

It is a further significant problem, in particular in the case of LWC- and SC-papers, that such papers form very dense rolls on the reeling drum, which rolls are also rigid. The reeling drum is, however, deflected because of the load, and, since the rigid paper roll present on the reeling drum cannot deflect to a corresponding extent, the pressure produced by the paper roll on the reeling drum is considerably higher at the edges of the reeling drum than in its middle area. These drawbacks produce web breaks and roll-bottom broke in the reeling, and the amount of broke in one roll may be of an order of up to 2000 meters. Thus, in a paper mill, the annual losses incurred because of broke amount even to dozens of millions of FIM.

In the prior art, attempts have been made to eliminate the problems arising from deflection of the reeling drum and from the resulting unfavorable distribution of pressure so that the diameter of the reeling drum has been made larger. In this way, of course, the effect has been achieved that the deflection of the reeling drum has been reduced, whereby the differences in the pressure distribution on the reeling drum are lower accordingly.

However, it is a major drawback of this solution that it is not been possible to reel an equally large amount of paper onto a reeling drum with a large diameter as done previously. Thus, this solution also causes losses for the paper mills because of smaller paper rolls.

OBJECTS AND SUMMARY OF THE INVENTION

An object of the present invention is to provide a reeling drum which avoids or at least significantly reduces the above-mentioned drawbacks related to the prior art.

In view of achieving this object and others, in the present invention, the reeling drum is provided with means for variation of the deflection of the reeling drum and for equalization of the pressure produced by the material web reeled onto the reeling drum.

An important advantage of the invention over the prior art is that, by means of a solution in accordance with the invention, the pressure arising from the load of the paper roll on the reeling drum can be made substantially more uniform, in which case bottom broke is not formed to a corresponding extent.

A second important advantage of the present invention is that it is possible to reel a considerably larger amount of paper or board onto a reeling drum than in prior art.

Other advantages and characteristic features of the invention will come out from the following detailed description of the invention.

BRIEF DESCRIPTION OF THE DRAWINGS

The following drawings are illustrative of embodiments of the invention and are not meant to limit the scope of the invention as encompassed by the claims.

DETAILED DESCRIPTION

Figure 1:
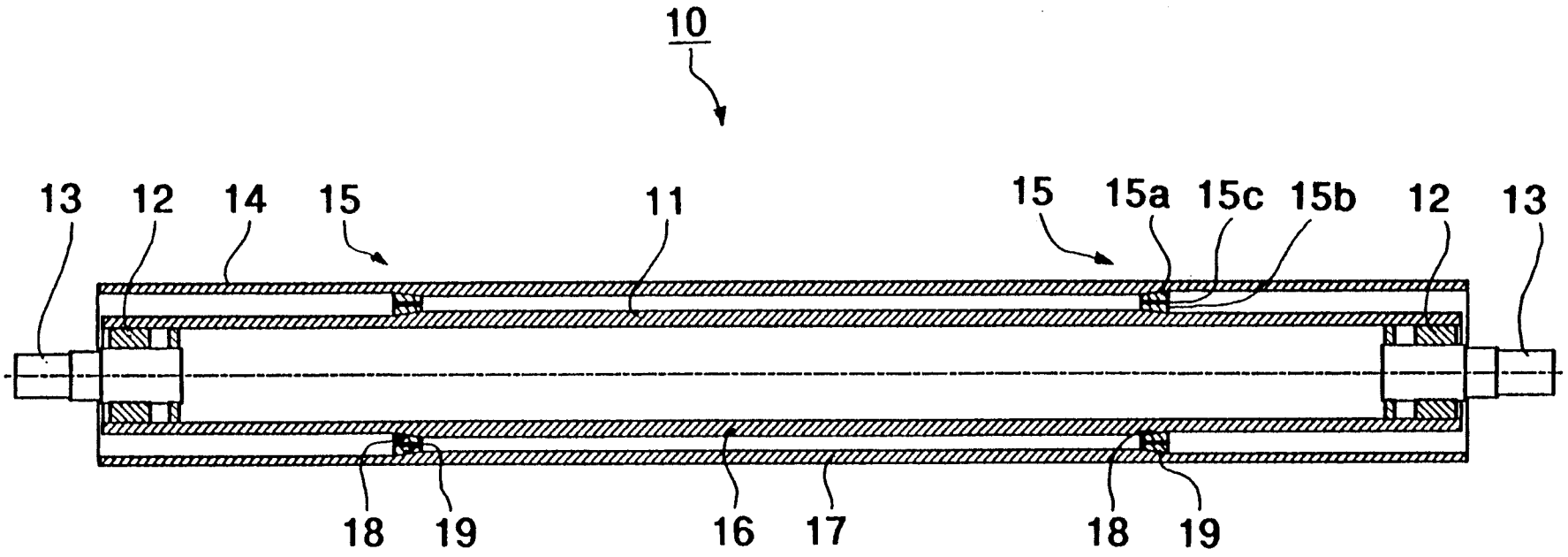
FIG. 1 is a fully schematic view of a first alternative embodiment of a reeling drum in accordance with the invention.

In FIG. 1, the reeling drum is denoted generally with the reference numeral 10. The reeling drum 10 comprises an inner mantle 11, to both of whose ends the axle journals 13 are fixed by means of end joints 12, the reeling drum 10 being mounted on the machine frame on said axle journals 13.

Figure 2:
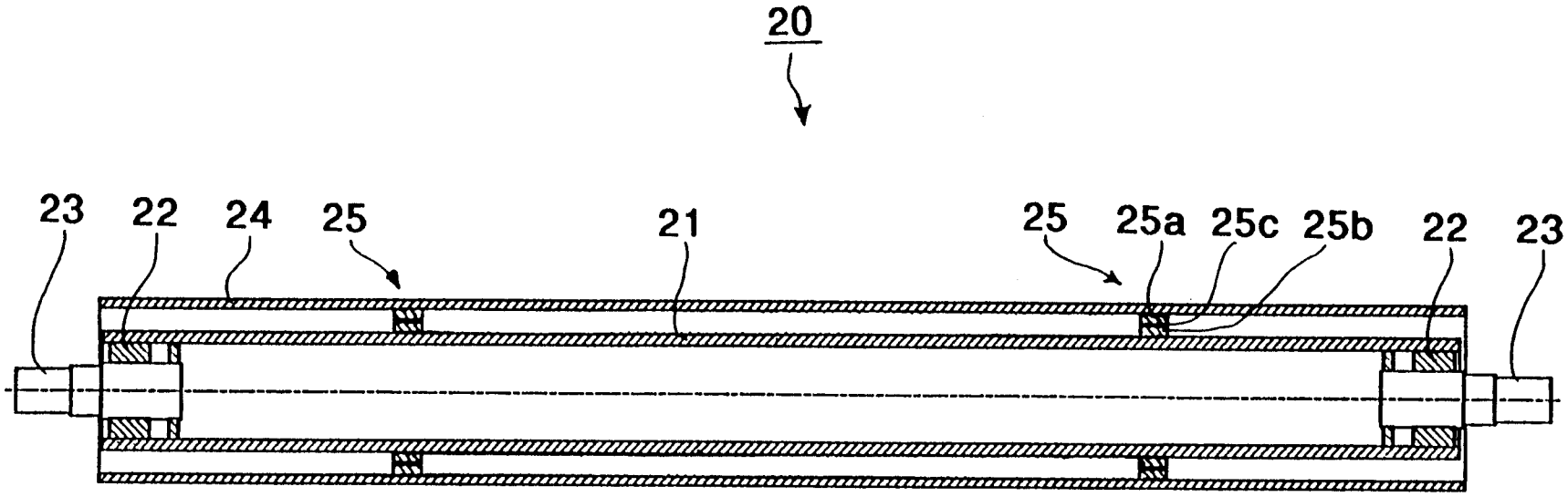
FIG. 2 is an illustration corresponding to FIG. 1 of a second alternative embodiment of the invention.

Thus, in a reeling drum 10 in accordance with the invention, the inner mantle 11 acts as the member that receives and carries the loads applied to the reeling drum. In the solution in accordance with the invention, onto the inner mantle 11, an outer mantle 14 of larger diameter has been fitted so that a gap remains between the inner mantle 11 and the outer mantle 14, which gap permits deflection of the inner and the outer mantles 11,14 in relation to one another. As shown in FIGS. 1 and 2, the gap between the outer mantle 14 and the inner mantle 11 preferably extends along the entire length of the reeling drum from one end to the opposite end.

An object of this solution is that, by means of the outer mantle 14, the deflection of the inner 11 mantle arising from the load should be compensated for as well as possible. Thus, the reeling drum 10 in accordance with the invention is provided with crown variation.

As is shown in FIG. 1, the outer mantle 14 is supported on the inner mantle 1 by means of articulation devices 15. The articulation devices 15 are placed along the axial length of the reeling drum 10 so that they are placed at a distance from the ends of the outer and the inner mantles 11,14. As the optimal locations of the articulation devices 15 in the axial direction can be considered the Bessel points. However, in practice, the articulation devices 15 can be placed at some points between the mantle ends and the Bessel points.

The construction of the articulation devices 15 is such that, in an axial section as shown in FIG. 1, they permit deflection of the inner and the outer mantles 11,14 in relation to one another. The articulation devices 15 may be substantially torsionally rigid, in which case they prevent rotation of the inner and the outer mantles 11,14 in relation to one another, or the articulation devices 15 may be roller bearings or slide bearings, in which case they permit free rotation of the outer mantle 14 around the inner mantle 11.

The articulation devices 15 may comprise an outer ring 15*a* connected to the outer mantle 14, of an inner ring 15*b* connected to the inner mantle 11, and a joint member 15*c* interconnecting the inner and the outer rings. The joint member 15*c* may be, e.g., of rubber or equivalent, which is fixed by vulcanizing onto the inner and the outer mantles 11,14 of the reeling drum in some suitable way. In the embodiment depicted in FIG. 1, this has been accomplished so that, on the middle portion of the inner mantle 11 and, correspondingly, on the middle portion of the outer mantle 14, thicker portions 16, 17 have been formed, which are thicker than the end areas of the inner and the outer mantles 11,14. At the points of installation of the articulation devices 15, between the end areas of the mantles and the thicker portions 16,17, conical faces 18,19 have been formed so that the articulation devices 15 have been attached to the inner and the outer mantles 11,14 by means of conical joints.

In FIG. 2, a second alternative embodiment of a reeling drum in accordance with the invention is shown. In FIG. 2, the reeling drum is denoted generally with the reference numeral 20 and, in a way corresponding to FIG. 1, the reeling drum 20 comprises an inner mantle 21, to whose ends the axle journals 23 have been fixed by means of end joints 22, the reeling drum 20 being mounted on the machine frame on said axle journals 23. An outer mantle 24 is mounted coaxially on the inner mantle 21, and is supported on the inner mantle 21 by means of articulation devices 25. The operation and the locations of the articulation devices are similar to those of the articulation devices 15 in FIG. 1.

Thus, the articulation devices 25 shown in FIG. 2 comprise an outer ring 25*a* attached to the outer mantle 24, an inner ring 25*b* attached to the inner mantle 21, and joint members 25*c* interconnecting the outer and the inner rings 25*a*,25*b* and permitting deflection of the inner and the outer mantle 21,24 in relation to one another. Torsionally rigid articulation devices 25 prevent rotation of the inner and the outer mantle 21,24 in relation to one another, or the articulation devices 25 may be roller bearings or slide bearings, in which case they permit free rotation of the outer mantle 24 around the inner mantle 21.

The embodiment depicted in FIG. 2 differs from the embodiment of FIG. 1 in the respect that, in FIG. 2, the inner and the outer mantles 21,24 are formed as of uniform thickness in the axial direction, without thicker portions. The articulation devices 25 are attached to the inner and the outer mantles in some suitable way.

Figure 3:
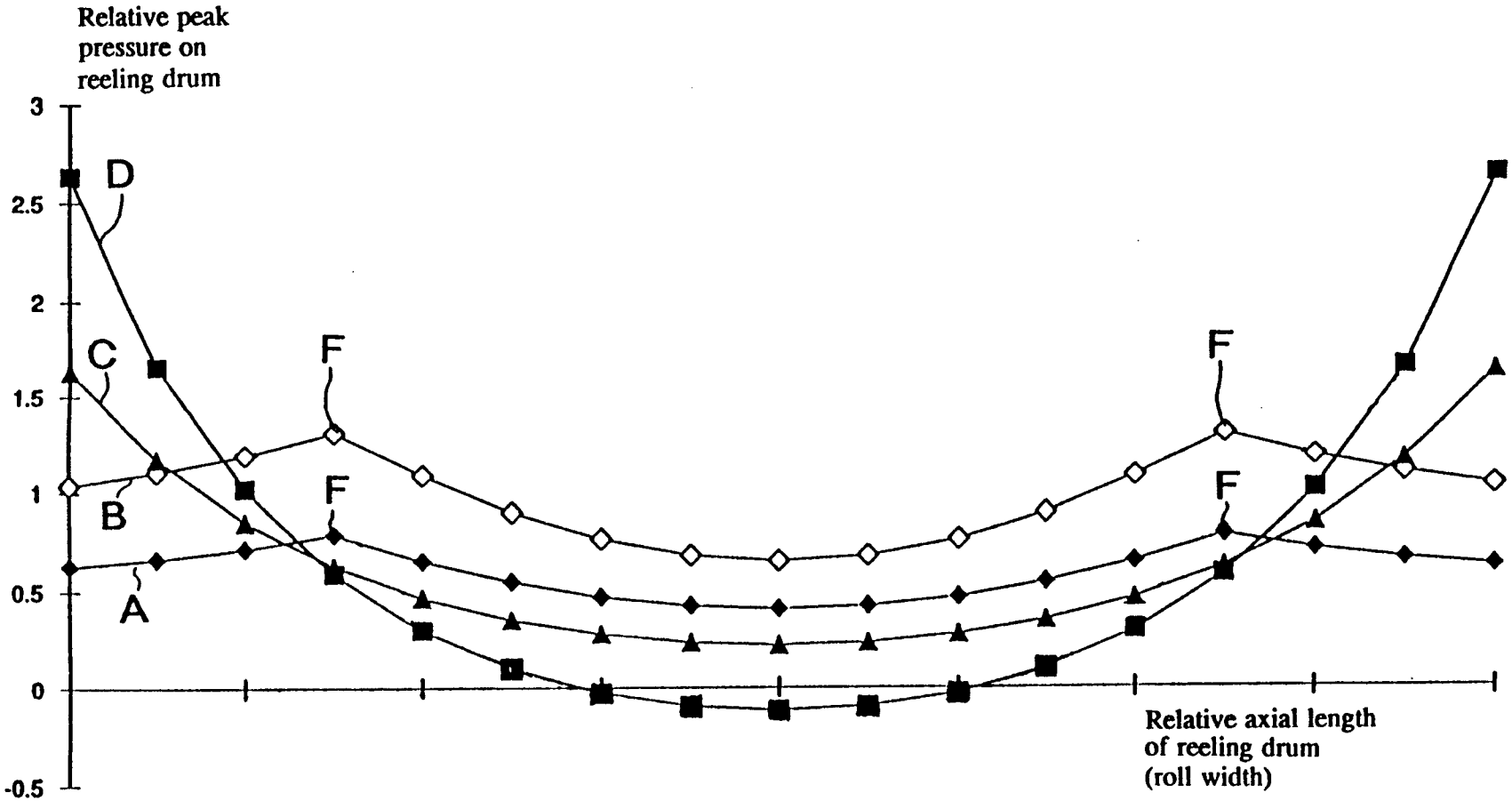
FIG. 3 is a schematic graphic illustration of the pressure produced by the paper roll on the reeling drum.

FIG. 3 is a schematic and graphic presentation of the effect produced by means of the solution in accordance with the invention as compared with prior-art solutions.

In the graphic presentation in FIG. 3, the vertical axis represents the relative pressures produced by the load on the reeling drum and, in a corresponding way, the horizontal axis represents the relative axial length of the outer mantle, i.e. the width of the roll.

The curve denoted with the reference D in FIG. 3 represents a conventional single-mantle reeling drum, whose diameter is 825 mm. Onto this reeling drum, paper has been reeled so that the diameter of the paper roll is 2700 mm, which is an ordinary roll size used in reeling. As can be seen from the figure, the load and the pressure produced by the roll on the reeling drum is, at the ends of the roll, a multiple of the load in the middle area.

In FIG. 3, the curve denoted with the reference C represents a conventional single-wire reeling drum that has a larger diameter, 1220 mm. In the case denoted with the reference C, paper web has been reeled onto the reeling drum so that the diameter of the roll is 3400 mm. As can be seen, in the case C, it has been possible to lower the peak pressures occurring at the roll ends as compared with the case D. Nevertheless, the pressures effective at the ends are substantially higher than in the middle areas.

It is a further drawback of the case C that it has been necessary to increase the diameter size of the roll considerable even though the amount of the paper web reeled has, however, not increased to a considerable extent, because the diameter of the reeling drum is substantially larger than normally.

In FIG. 3, the curves denoted with the references A and B represent a reeling drum in accordance with the invention, and the points denoted with the references F on the curves A and B means the points of location of the articulation devices on the reeling drum.

In the case denoted with the reference A, the diameter of the outer mantle of the reeling drum in accordance with the invention is 825 mm, and paper has been reeled onto the reeling drum so that the diameter of the roll is 2700 mm. As is shown in FIG. 3, by means of the solution of the invention (case A), a considerable reduction of the peak pressures is achieved as compared with the reeling drums of normal constructions (case D), the pressure produced by the load being substantially uniform across the roll width with a reeling drum in accordance with the invention.

In the case denoted with the reference B, the diameter of the outer mantle of the reeling drum in accordance with the invention is still 825 mm. However, in the case of the curve B, paper web has been reeled onto the reeling drum so that the diameter of the roll is 3400 mm. In the case B in accordance with the invention, the pressures and the loads are substantially lower and more uniform as compared with the conventional reeling drums (cases C and D).

From FIG. 3, it should be further noticed that, in the alternative in accordance with the invention (case B), the amount of paper in the roll is substantially larger than on the conventional reeling drum (case C), even though the diameter is the same in these cases. This comes from the fact, as was already stated above, that, in the case B in accordance with the invention, the diameter of the reeling drum is smaller than in the conventional case C. Thus, by means of the invention, a considerable improvement is achieved over the prior art both in respect of the loading and in the respect that a larger amount of paper can be reeled onto the reeling drum than in prior art.

Above, the invention has been described by way of example with reference to the figures in the accompanying drawing. The invention is, however, not confined to the exemplifying embodiments shown in the figures alone, but many variations are possible within the scope of the inventive idea defined in the accompanying patent claims.

What is claimed is:

1. A reeling drum for a paper or board machine or equivalent, onto which reeling drum a material web, in particular paper or board, is reeled, comprising first and second ends of said reeling drum, an end joint being arranged at each of said first and second ends, axle journals fixed to said first and second ends of said reeling drum by means of said end joints, said axle journals structured to support said reeling drum revolvingly on a machine frame by bearing means, an inner mantle structured and arranged to be supported on the machine frame revolvingly, an outer mantle fitted over said inner mantle coaxially such that a gap remains between said inner mantle and said outer mantle, said gap extending along an axial length of said reeling drum from said first end of said reeling drum to said second end of said reeling drum, and means for varying the deflection of said reeling drum and for equalizing the pressure produced by a material web reeled onto said reeling drum, said means for varying the deflection of said reeling drum comprising articulation devices supporting said outer mantle on said inner mantle and being arranged in said gap such that a substantially uniform pressure load is applied by the material web over the axial length of said reeling drum.

2. The reeling drum of claim 1, wherein said outer mantle is supported on said inner mantle by means of said articulation devices at two locations, such that articulation devices are located at a distance between each of said first and second ends of said reeling drum and a middle of said reeling drum.

3. The reeling drum of claim 2, wherein said articulation devices are placed at Bessel points calculated from said ends of the reeling drum.

4. The reeling drum of claim 2, wherein said articulation devices are structured and arranged to permit deflection of said inner and said outer mantles of said reeling drum in relation to one another but prevent their rotation in relation to one another.

5. The reeling drum of claim 2, wherein said articulation devices are structured and arranged to permit deflection of said inner and said outer mantles of the reeling drum in relation to one another and to permit rotation of said outer mantle in relation to said inner mantle.

6. The reeling drum of claim 2, wherein said articulation devices are attached to at least one of said inner or outer mantles by means of conical joints.

7. The reeling drum of claim 6, wherein said articulation devices are attached to both of said inner or outer mantles by means of conical joints.

8. The reeling drum of claim 2, wherein at least one of said inner mantle and said outer mantle is structured such that it is substantially thicker in an area between the articulation devices in relation to an area between said articulation devices and said first and second ends of said reeling drum.

9. The reeling drum of claim 2, wherein at least one of said inner and said outer mantle is structured such that it is of uniform thickness substantially over its entire axial length.

10. The reeling drum of claim 2, wherein said articulation devices comprise an outer ring attached to said outer mantle, an inner ring attached to said inner mantle, and a joint member that interconnects said inner and outer rings.

11. The reeling drum of claim 10, wherein said articulation devices are torsionally rigid, and said joint member is made of rubber which has been fixed by vulcanization to said outer and said inner rings of said articulation device.

12. A reeling drum for a paper or board machine or equivalent, onto which reeling drum a material web, in particular paper or board, is reeled, comprising first and second ends of said reeling drum, an end joint being arranged at each of said first and second ends, axle journals fixed to said first and second ends of said reeling drum by means of said end joints, said axle journals structured to support said reeling drum revolvingly on a machine frame by bearing means, an inner mantle structured and arranged to be supported on the machine frame revolvingly, an outer mantle arranged coaxially over said inner mantle such that a gap is formed between said inner mantle and said outer mantle, and means for varying the deflection of said reeling drum and for equalizing the pressure produced by a material web reeled onto said reeling drum, said means comprising a pair of articulation devices arranged in said gap between said outer mantle and said inner mantle such that said outer mantle is supported on said inner mantle at two locations, each of said pair of articulation devices being located in the vicinity of Bessel points calculated from said first and second ends of said reeling drum.

13. The reeling drum of claim 12, wherein said articulation devices are structured and arranged to permit deflection of said inner and said outer mantles of said reeling drum in relation to one another but prevent their rotation in relation to one another.

14. The reeling drum of claim 12, wherein said articulation devices are structured and arranged to permit deflection of said inner and said outer mantles of the reeling drum in relation to one another and to permit rotation of said outer mantle in relation to said inner mantle.

15. The reeling drum of claim 12, wherein said articulation devices are attached to at least one of said inner or outer mantles by means of conical joints.

16. The reeling drum of claim 13, wherein said articulation devices are attached to both of said inner or outer mantles by means of conical joints.

17. The reeling drum of claim 12, wherein at least one of said inner mantle and said outer mantle is structured such that it is substantially thicker in an area between the articulation devices in relation to an area between said articulation devices and said first and second ends of said reeling drum.

18. The reeling drum of claim 12, wherein said gap extends along an axial length of said reeling drum from said first end of said reeling drum to said second end of said reeling drum.

19. The reeling drum of claim 12, wherein said articulation devices comprise an outer ring attached to said outer mantle, an inner ring attached to said inner mantle, and a joint member that interconnects said inner and outer rings.

20. The reeling drum of claim 19, wherein said articulation devices are torsionally rigid, and said joint member is made of rubber which has been fixed by vulcanization to said outer and said inner rings of said articulation device.

* * * * *